US005890810A

United States Patent [19]

Barlow

[11] Patent Number: 5,890,810

[45] Date of Patent: Apr. 6, 1999

[54] MANUFACTURE OF BAGS

[75] Inventor: Garry Barlow, Newport, United Kingdom

[73] Assignee: Poly-Lina Ltd., Enfield, United Kingdom

[21] Appl. No.: 943,250

[22] Filed: Oct. 17, 1997

Related U.S. Application Data

[63] Continuation of Ser. No. 631,089, Apr. 12, 1996, abandoned, which is a continuation-in-part of Ser. No. 382,267, Feb. 1, 1995, abandoned.

[51] Int. Cl.[6] ..... B65D 30/20

[52] U.S. Cl. ..... 383/120; 206/390; 383/8; 493/196; 493/244

[58] Field of Search ..... 383/8, 120; 493/196, 493/167, 243, 244

[56] References Cited

U.S. PATENT DOCUMENTS

| | | | |
|---|---|---|---|
| 4,759,742 | 7/1988 | Achelpohl | 493/243 |
| 4,807,754 | 2/1989 | Rowe | 206/390 |
| 4,846,349 | 7/1989 | Galimberi | 383/8 |
| 5,192,133 | 3/1993 | Juel et al. | 383/120 |

FOREIGN PATENT DOCUMENTS

| | | | |
|---|---|---|---|
| 2274446 | 7/1994 | United Kingdom | 383/120 |

*Primary Examiner*—Stephen P. Garbe

*Attorney, Agent, or Firm*—Watson Cole Grindle Watson, P.L.L.C.

[57] ABSTRACT

An extruded plastics tube is flattened and the lateral side portions (4) are folded to form inwardly extending gussets (2). Each gusseted side portion is then folded about a longitudinal fold line (5) onto the medial portion (3) between the side portions. The resultant layers are heat sealed to form the bottom of the bag.

13 Claims, 3 Drawing Sheets

MANUFACTURE OF BAGS

CROSS-REFERENCE TO RELATED APPLICATIONS

The present application is a continuation of application Ser. No. 08/631,089, filed Apr. 12, 1996, now abandoned, which was a continuation-in-part of U.S. patent application Ser. No. 08/382,267, filed Feb. 1, 1995, now abandoned.

BACKGROUND OF THE INVENTION

1. Field of the Invention

This invention relates to the manufacture of plastics bags, e.g., for use as bin liners.

2. The Prior Art

It is well known to manufacture plastic bags by extruding a tube of polyethylene, expanding the tube to reduce the thickness of the polyethylene film, flattening the tube and then heat sealing and severing or perforating the tube across its width. The heat seals form the bottoms of the bags. If the bags are initially divided by transverse perforation lines, a series of bags can be wound into a roll for supply to a customer who can tear individual bags off the roll as required for use. In order to reduce the size of the machinery demanded and also to improve the strength of the welded seals, it is well known to fold the polyethylene tubing prior to the heat sealing operation. An especially effective seal is obtained if the tubing is folded as described in GB-A-1584746. According to this method the sides of the tubing are folded inwardly to form longitudinal gussets which reach in substantially to the longitudinal centre line of the layflat tubing, and the gusseted tubing is then folded in half onto itself about the longitudinal centre line. When folded in this way, eight layers of film become welded together over substantially the whole length of the heat seal subsequently produced, and a strong seal is obtained. However, this folding method is not suitable for the manufacture of rolls of interconnected bags formed, by appropriate cutting, with handles at the bag mouths. Such handles may be desirable for tying closed the bag after it has been filled, e.g., with refuse. Because the gusseted tubing is folded in half, handles formed at the side edges, i.e., at the folds of the gussets, will be superimposed at the same side of the folded tube, and the resulting string of bags can not be satisfactorily wound into a roll.

SUMMARY OF THE INVENTION

The present invention seeks to overcome this drawback of the prior art method and accordingly provides a method of manufacturing bags from layflat plastics tubing, which includes the steps of folding lateral side portions of the tubing to form gussets extending inwardly to a depth not greater than one third the width of the gusseted tubing, folding each gusseted side portion over about a longitudinal fold line onto a respective face of a medial tubing portion between the side portions and transversely heat sealing the folded gusseted tubing.

Conveniently, the longitudinal fold lines substantially coincide with the inner edges of the gussets. In the preferred embodiment described in more detail below, the gussets have a depth substantially equal to one third the width of the gusseted tubing, and the longitudinal fold lines are spaced at a distance substantially equal to one third the width of the gusseted tubing, whereby the finally folded tubing has a width substantially equal to one fifth the width of the unfolded tubing laid flat, and ten layers of film are welded together over substantially the entire length of the seal across the folded tubing.

The invention also provides a bag formed from layflat plastics tubing and includes three superimposed portions including two outer portions sandwiching a central portion, the two outer portions having gussets extending inwardly to a depth not greater than the width of the outer portions, and a heat seal extending across substantially the entire width of the three superimposed portions at a base of the bag and sealing together the three superimposed portions.

According to another aspect of this invention there is provided a bag formed from layflat plastics tubing and including an open upper end, a closed base end, three superimposed portions between the upper end and base end including two outer portions sandwiching a central portion, the two outer portions having gussets extending inwardly to a depth not greater than the width of the outer portions, a base heat seal extending across substantially the entire width of the three superimposed portions adjacent the base end of the bag, and a pair of handles formed by extended section of the gusseted outer portion projecting longitudinally of the central portion at the upper end of the bag. As the handles of the bag are laterally opposed, a string of such bags can be wound into a acceptable roll.

A clear understanding of the invention will be gained from the following detailed description of a presently preferred embodiment, reference being made to the accompanying drawings.

BRIEF DESCRIPTION OF THE DRAWINGS

FIG. 6 is a perspective view of a roll of interconnected bags, partially unwound.

DETAILED DESCRIPTION OF THE PREFERRED EMBODIMENT

Figure 1:
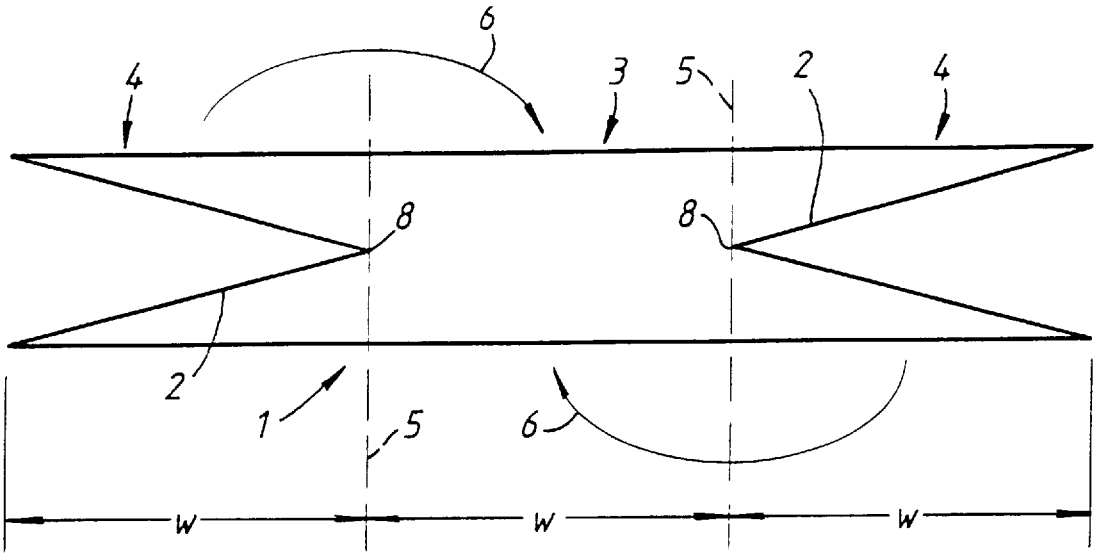
FIG. 1 is a cross-section through the tubing after the first stage of folding.
Figure 2:
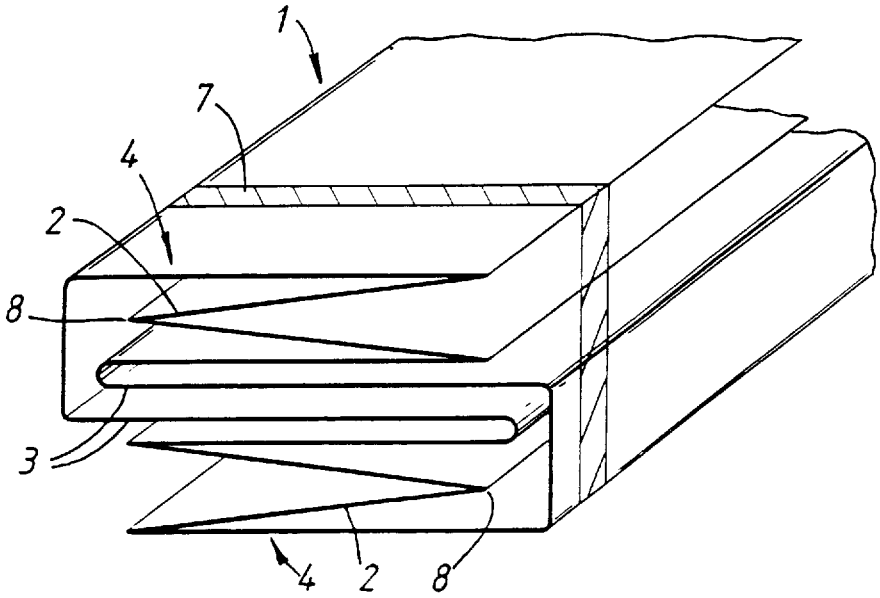
FIG. 2 is a schematic sectioned perspective view showing the folded and sealed tubing.

The tubing used for bag manufacture is produced by conventional extrusion methods which are well known in the art and do not form any part of the present invention. The tubing 1 coming from the extrusion equipment is folded inwardly from the sides and flattened, so as to form equal gussets 2 having a depth w substantially equal to one third the width of the gusseted tubing, thereby leaving a medial tubing portion 3 of width w between the two gusseted side portions 4 also of width w. (In the drawing the layers of plastic film are shown separated, but this is for ease of illustration only and it will be understood that in practice they lie flat against each other.) Next the gusseted side portions 4 are folded over about respective longitudinal fold lines 5 to lie against the opposite side faces of the medial portion 3, as indicated by the arrows 6 in FIG. 1, so that the folded tubing assumes the configuration illustrated in FIG. 2. A welded seal 7 is produced across the full width of the folded tubing by applying a heated blade against the folded tubing in well known manner, and as will be seen from FIG. 2, ten layers of film become welded together over essentially the complete length of the seal. A very strong seal is obtainable as a result.

Tests have shown the seal does not have any identifiable weak points.

Figure 3:
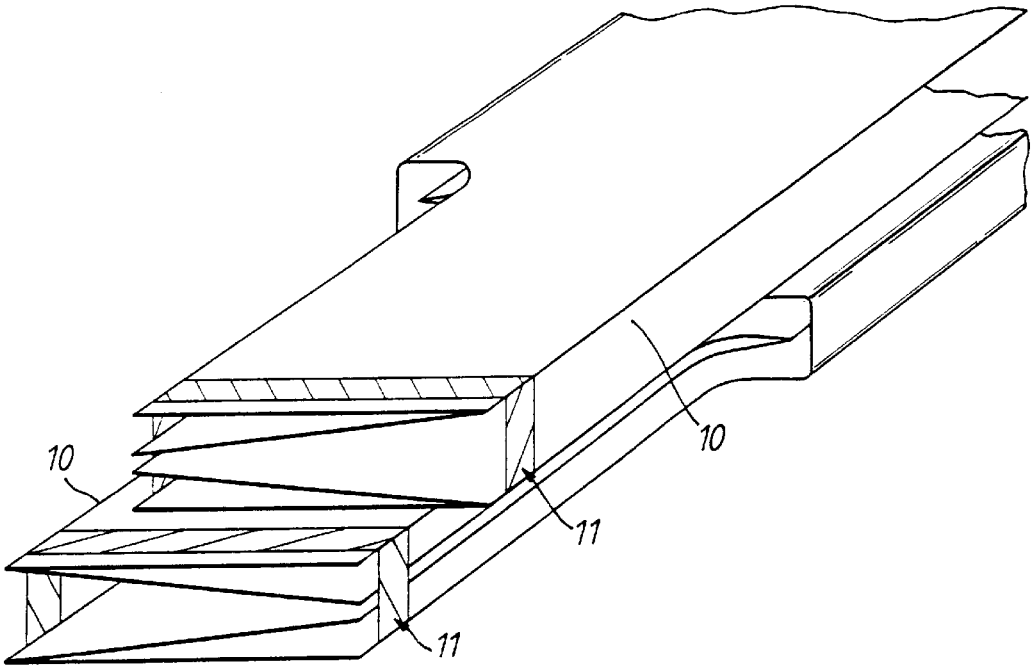
FIG. 3 is a similar schematic view showing the upper end of the finished bag when folded.
Figure 4:
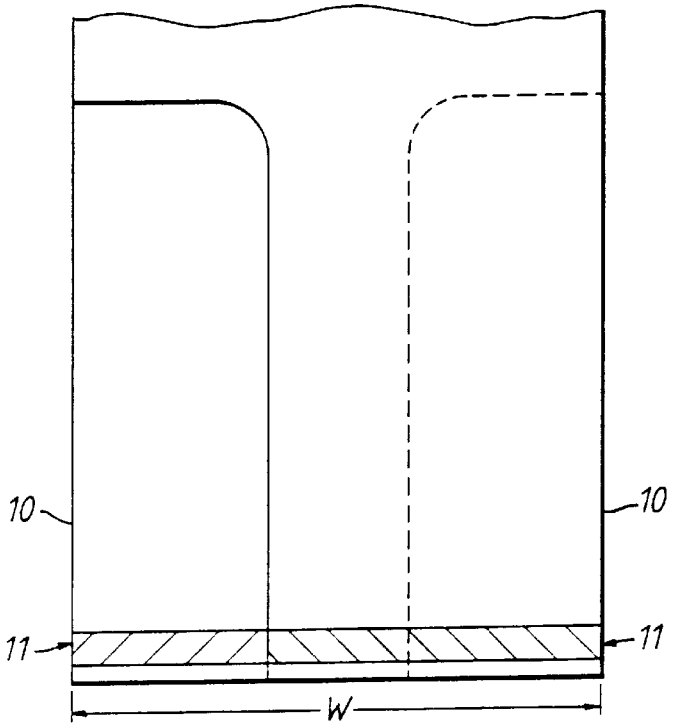
FIG. 4 is a plan view of the upper end of the folded bag shown in FIG. 3.
Figure 5:
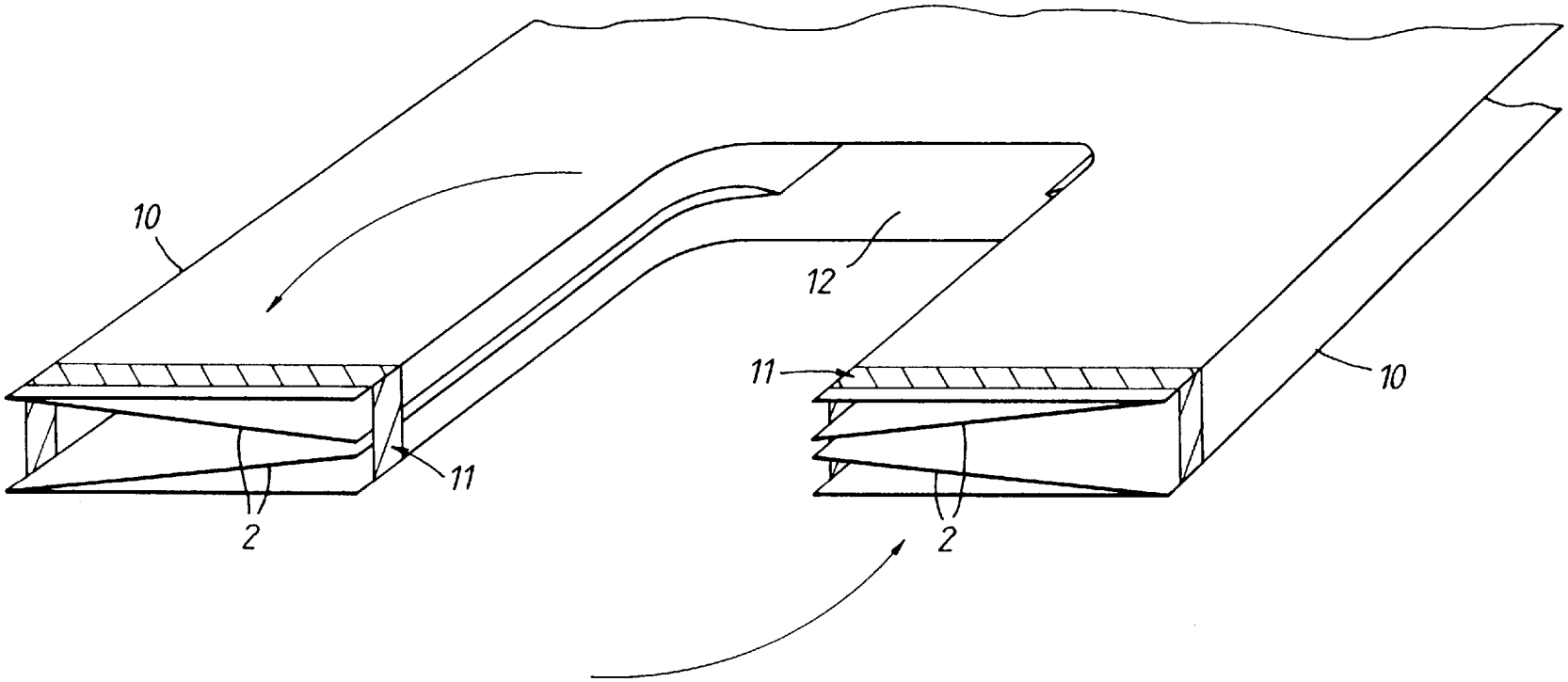
FIG. 5 is a similar view to FIG. 3 showing the bag unfolded and ready to be opened.

FIGS. 3, 4 and 5 show the upper end of the bag which is open and has a pair of handles 10 provided by removal of a bag segment, for example, by an appropriate cutting operation. The handles 10 are formed at opposite sides of the gusseted tubing 1 and have a width less than the gusset width but greater than w/2 so that when the bag is folded, the handles overlap in the central region of the folded bag. Preferably, the width of each handle is around ⅔W. A welded seal 11 is produced across the upper ends of the handles by applying a heated blade, wire or bar, in a similar manner to the production of the welded seal 7, to connect the layers of plastic film forming the handles. As the handles are positioned laterally of each other after folding, a continuous tube of gusseted plastics film can be formed into a continuous series of bags, with the handles of one bag connected to the base of the next bag and the interconnected bags can be wound up into an acceptable roll without difficulty. Further, by providing suitable perforations between the base seal 7 of one bag and the handle seals 11 of the next bag, single bags can be easily separated for use by tearing bags apart at the perforations. FIG. 5 shows the upper end of the bag unfolded ready for use with the handles 10 to the sides of the mouth of the bag 12. After the bag has been used, the mouth 12 can be closed by tying the handles together, if desired.

FIG. 6 shows a partially unwound roll of interconnected bags according to the invention.

I claim:

1. A method of manufacturing bags from layflat plastics tubing, comprising the steps of extruding tubing of unitary polyethylene film, folding lateral side portions of the tubing to form gussets extending inwardly to a depth not greater than one third the width of the gusseted tubing, folding each gusseted side portion over about a longitudinal fold line onto a respective face of a medial tubing portion between said side portions and transversely heat sealing the folded gusseted tubing.

2. A method of manufacturing bags as claimed in claim 1, wherein the longitudinal fold lines substantially coincide with inner edges of the gussets.

3. A method of manufacturing bags as claimed in claim 1, wherein the depth of the gussets is substantially equal to one third the width of the gusseted tubing and the longitudinal fold lines are spaced at a distance substantially equal to one third the width of the gusseted tubing, whereby the finally folded tubing has a width substantially equal to one fifth the width of the unfolded tubing laid flat.

4. A bag formed from layflat tubing formed from extruded unitary polyethylene film and comprising three superimposed portions including two outer portions sandwiching a central portion, the two outer portions having gussets extending inwardly to a depth not greater than the width of the outer portions, and a heat seal extending across substantially the entire width of the three superimposed portions at the base of the bag and sealing together the three superimposed portions.

5. A bag formed according to claim 4, wherein the two outer portions and the inwardly extending gussets are laterally substantially coextensive.

6. A bag according to claim 4, wherein the depth of the gussets is substantially equal to one third the width of the gusseted tubing.

7. A bag according to claim 4, wherein the heat seal has a maximum of ten layers.

8. A bag formed from layflat plastics tubing, said tubing comprising a film of extruded polyethylene, said bag comprising an open upper end, a closed base end, three superimposed portions between the upper end and base end including two outer portions sandwiching a central portion, the two outer portions having gussets extending inwardly to a depth not greater than the width of the outer portions, a base heat seal extending across substantially the entire width of the three superimposed portions adjacent the base end of the bag, and a pair of handles in the gusseted outer portions at the open end of the bag.

9. A bag formed according to claim 6, wherein the two outer portions and the inwardly extending gussets are laterally substantially coextensive.

10. A bag according to claim 6, wherein the width of the gussets is substantially equal to one third the width of the gusseted tubing.

11. A bag according to claim 6, wherein the base heat seal has a maximum of ten layers.

12. A plurality of bags formed from a continuous length of layflat plastics tubing, each bag being a defined in claim 6, wherein a transverse line of perforations is provided between the handles of one bag and the base seal of an adjoining bag to facilitate separation of individual bags.

13. A plurality of bags formed according to claim 12 configured in a roll.

* * * * *